United States Patent [19]

Jacobsen et al.

[11] 4,280,902

[45] Jul. 28, 1981

[54] SEPARATION OF DENSE IMPURITIES FROM A FLUID

[75] Inventors: Finn Jacobsen; Lennart Gustavsson, both of Karlstad, Sweden

[73] Assignee: Kamyr Aktiebolag, Karlstad, Sweden

[21] Appl. No.: 164,918

[22] Filed: Jun. 30, 1980

[30] Foreign Application Priority Data

Jul. 4, 1979 [SE] Sweden ..... 7905853

[51] Int. Cl.[3] ..... B04C 5/10

[52] U.S. Cl. ..... 209/211; 210/512.1

[58] Field of Search ..... 209/211, 144; 55/459 R, 55/459 A, 459 B, 459 C, 459 D; 210/84, 512 R, 512 A, 512 M

[56] References Cited

U.S. PATENT DOCUMENTS

| | | | |
|---|---|---|---|
| 2,377,524 | 6/1945 | Samson et al. | 92/28 |
| 3,049,467 | 8/1962 | Curry et al. | 162/55 |
| 3,061,098 | 10/1962 | Brezinski | 209/211 |
| 3,313,413 | 4/1967 | Delcellier | 209/211 |
| 3,513,642 | 5/1970 | Cornett | 209/144 X |
| 3,764,005 | 10/1973 | Zemanek | 209/211 |
| 3,771,290 | 11/1973 | Stethem | 210/512 R X |
| 3,898,068 | 8/1975 | McNeil | 55/459 A X |
| 4,156,485 | 5/1979 | Skardal | 209/211 X |

FOREIGN PATENT DOCUMENTS 344447 11/1921 Fed. Rep. of Germany .

*Primary Examiner*—William A. Cuchlinski, Jr.
*Attorney, Agent, or Firm*—Cushman, Darby & Cushman

[57] ABSTRACT

An apparatus and method for removing dense impurities, such as sand, from a fluid, such as liquids use in the production of cellulosic pulp. A vertically upstanding tank substantially circular in cross-section is provided including a top wall, bottom wall, and side wall. The fluid with dense impurities is introduced into the tank with a whirling motion. Vertical stagnation of the dense impurities against the side wall interior (which can result in damage to the tank wall) without dampening the whirling motion imparted to the fluid is prevented by mounting a perforated funnel in the tank at the area of the tank where the vertical stagnation is likely to occur.

21 Claims, 2 Drawing Figures

SEPARATION OF DENSE IMPURITIES FROM A FLUID

BACKGROUND AND SUMMARY OF THE INVENTION

In many art areas it is desirable to be able to remove dense impurities, such as sand, from fluids. Particularly in the art of pulp and paper manufacture, it is desirable to remove sand and like particles from liquids used in the manufacture of cellulosic pulp, such as digesting, washing and bleaching liquors. Conventionally this is accomplished utilizing a hydrocyclone, such as shown in U.S. Pat. No. 2,377,524. In such devices. the liquor is introduced into a tank with a forceful whirling motion. Heavier particles, such as sand, are driven by the centrifugal force of the whirling action toward the wall of the tank. When reaching the tank wall under the action of gravity such dense particles descend toward the bottom of the tank and exit an outlet in the tank bottom.

While prior art hydrocyclones are generally successful in performing the desired separation of dense impurities from liquid, there are some problems associated therewith. Since the lower portion of the hydrocyclone is conventionally conical, the fluid vortex is constricted adjacent the tank bottom so that the fluid has a gradually increasing angular velocity. At a certain vertical zone of the tank wall, the resultant of the forces acting upon the sand particles—centrifugal force and the force of gravity—will be directed perpendicularly to the tank wall. This results in vertical stagnation of the dense particles at the wall in that zone, instead of the particles moving downwardly toward the bottom outlet. While vertically stagnated, the particles travel in a circular motion under the influence of the fluid's centrifugal force, causing abrasion between the particles and the tank side wall. The result of this abrasion is a weakening of the tank side wall, and—depending upon the abrasiveness of the particles—puncture of the tank wall after a relatively short operating time.

Prior attempts to overcome the problem of tank side wall damage as a result of particle stagnation have included the insertion of vertical plates in the stagnation area, and the design of the conicity of the tank lower section so that there is a relatively gradual taper of the conical section. Each of these techniques, however, results in a dampening of the whirling motion of the fluid, and thus impairs the ability of the hydrocyclone to effect dense particle separation.

According to the apparatus and method of the present invention, it is possible to prevent vertical stagnation of dense impurities against the side wall interior of a hydrocyclone without dampening the whirling motion imparted to the fluid. The result is a much longer life of the tank side wall for a given abrasiveness of the particles to be separated. Additionally, the portion of the apparatus at which stagnation is likely to occur is replaceable so that the entire hydrocyclone tank need not be replaced or repaired if damage should still occur as a result of vertical stagnation of particles.

According to one aspect of the apparatus of the present invention, a vertically upstanding tank substantially circular in cross-section is provided, which tank includes a top wall, bottom wall, and side wall. Means are provided for introducing, tangentially to the side wall, fluid having dense impurities into the tank adjacent the top wall thereof to impart whirling motion to the fluid within the tank. A fluid outlet is disposed substantially centrally in the top wall of the tank and an impurities outlet is disposed centrally in the bottom wall of the tank. Means are provided for preventing vertical stagnation of dense impurities against the side wall interior at a particular vertical level without dampening the whirling motion imparted to the fluid. Such means comprise a funnel means; means defining perforations (larger than the average dimensions of the impurities) in the funnel means at areas thereof wherein stagnation of dense impurities is likely to occur; and means for operatively mounting the funnel means to the tank side wall between the suspension inlet and the impurities outlet so that dense impurities being separated must pass through the funnel means in transit to the impurities outlet, and so that the funnel means at the perforated areas thereof is spaced from the tank side wall and the impurities outlet is in open communication with the interior of the funnel means through the perforations.

Preferably the funnel means according to the invention comprises a conical member having an open large end mounted above a small end thereof, and the means for mounting the funnel means to the tank's side walls comprises an annular flange rigidly mounted to the exterior of the funnel means, and clamping means associated with upper and lower sections of the side wall for receiving the flange therebetween and holding it in place with respect to the side wall. The tank side wall upper section may include a top cylindrical portion and a bottom conical portion having a clamping means associated therewith, and the conical member and the tank upper section conical bottom portion have substantially the same conicity—preferably about 15° to 30°. Alternatively, the tank side wall may comprise a cylindrical upper portion and a conical lower portion with the means for mounting the funnel means to the tank side wall comprising means for rigidly attaching the funnel large end to the interior of the side wall at the cylindrical portion so that the funnel means extends concentrically downwardly into the tank lower portion spaced from the side wall lower portion. In order to facilitate discharge of separated impurities through the impurities outlet, means may be provided for introducing liquid under pressure tangentially into the volume between the funnel and the tank bottom wall, the liquid being introduced in this area being introduced with a much calmer whirling action than the whirling action imparted to the fluid at the fluid inlet.

According to another aspect of the present invention, apparatus is provided for removing dense particles from a suspension comprising a vertically upstanding tank substantially circular in cross-section including a top wall, bottom wall, and side wall. A first conduit is provided in communication with the tank interior and extending tangentially to the side wall, and adjacent the top wall. A second conduit is disposed substantially centrally in the top wall of the tank and a third conduit is disposed substantially centrally in the bottom wall of the tank. Funnel means having a relatively large open end and a relatively small second end are provided with means defining perforations larger than the average dimension of the dense particles in at least areas of the funnel means adjacent the second end thereof, and means are provided for operatively mounting the funnel means to the tank side wall. The mounting means mount the funnel between the first conduit and the third conduit so that the funnel means first end is vertically above the second end, so that any suspension, particles, or the like passing between the first and third conduits must pass through the funnel means, and so that the funnel means at the perforated areas thereof is spaced from the tank side wall with the funnel means second end above the third conduit and with the third conduit being in open communication with the interior of the funnel means through the perforations.

According to the method of the present invention, separation of sand or like dense impurities from the fluid containing the impurities is provided. The method comprises (or consists of) the following steps: (a) Introducing fluid containing sand or like dense impurities into the first conduit of the apparatus to impart a whirling motion to the fluid within the tank. (b) Removing fluid with the sand or like dense impurities separated therefrom through the second conduit of the apparatus. (c) Removing sand or like dense impurities separated from the liquid through the third conduit of the apparatus; and (d) preventing vertical stagnation of dense impurities against the side wall interior at a particular vertical level without dampening the whirling motion imparted to the fluid. Step (d) is accomplished by utilizing a funnel having an open large first end and a small second end with perforations disposed in at least the area of the funnel adjacent the second end, and by operatively mounting the funnel to the tank side walls so that the first end thereof is vertically above the second end, and so that all sand or like dense impurities to pass through the third conduit must pass through the funnel, and so that the funnel at the areas thereof containing the perforations is spaced from the tank side wall is in open communication with the third conduit. Step (c) may be accomplished in part by introducing liquid under pressure tangentially to the tank side wall into the tank interior between the funnel and the third conduit to provide a whirling action which entrains separated sand or like dense impurities and carries it through the third conduit. The whirling action of the liquid in accomplishing step (c) is calmer than the whirling action of fluid in accomplishing step (a).

It is the primary object of the present invention to prevent vertical stagnation of dense impurities against the side wall interior of a hydrocyclone or the like without dampening the whirling motion imparted to the fluid. This and other objects of the invention will become clear from an inspection of the detailed description of the invention, and from the appended claims.

DETAILED DESCRIPTION OF THE DRAWINGS

Figure 1:
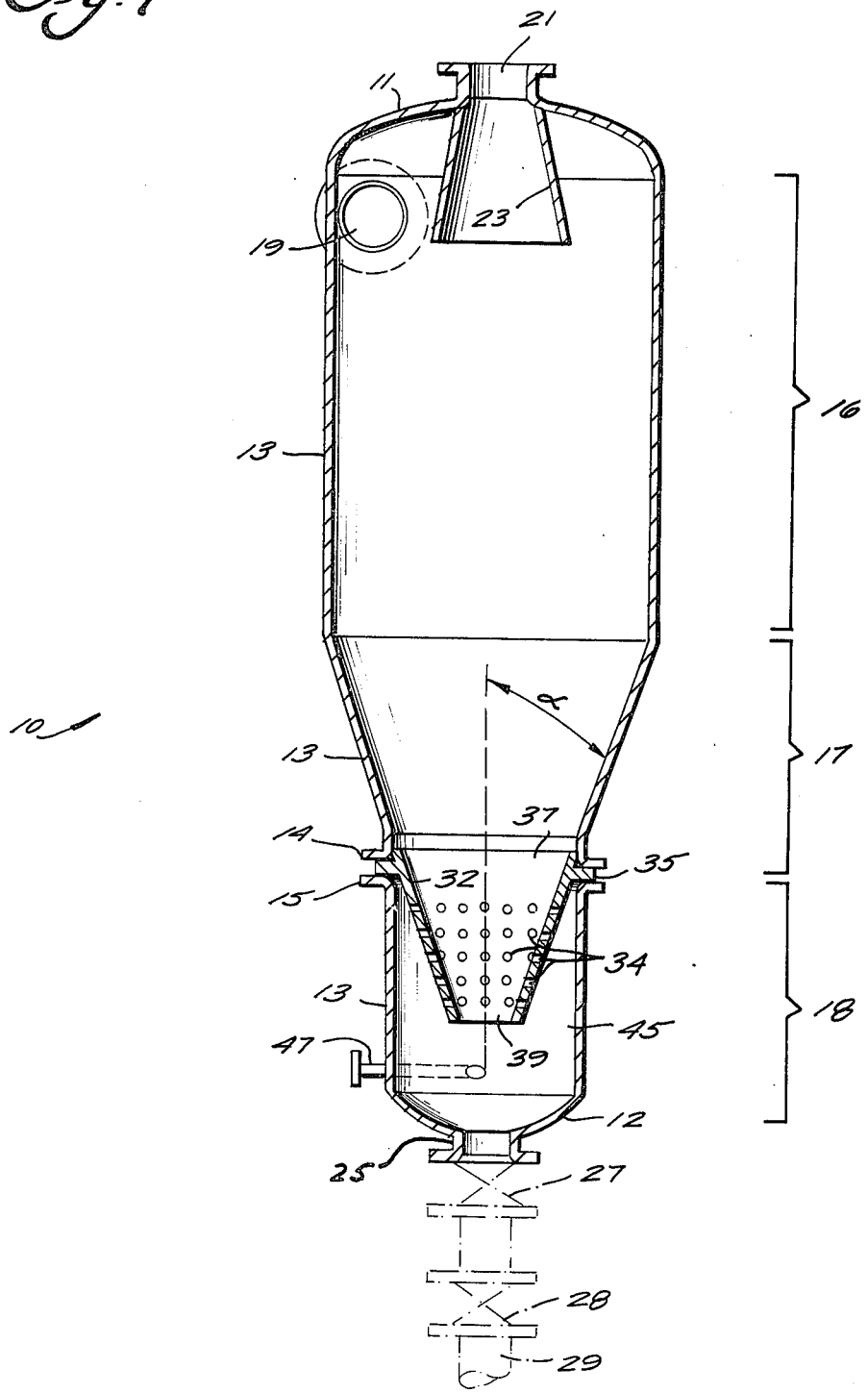
FIG. 1 is a side cross-sectional view illustrating an exemplary apparatus according to the present invention.

Exemplary apparatus for removing dense particulate impurities, such as sand, from a fluid suspension containing the particles is illustrated generally at 10 in FIG. 1. The apparatus includes a tank having a top wall 11, bottom wall 12, and side wall 13, the tank being substantially circular in cross-section. Preferably the tank side wall 13 includes an upper section and a lower section, each section having a clamp means 14, 15 respectively associated therewith. The upper section includes an upper portion 16 that is substantially cylindrical and a lower portion 17 (including annular clamping flange 14) that is conical. The lower section 18 of the side wall 13 is also preferably cylindrical.

The tank 10 includes a first conduit 19 which comprises means for, tangentially to side wall 13, introducing fluid having impurities into the tank adjacent the top wall 11 thereof, to impart a whirling motion to the fluid within the tank. A second conduit 21 is provided disposed substantially centrally in the top wall of the tank, the second conduit 21 comprising a fluid outlet from the tank 10. A vertical conical sleeve 23 preferably is associated with the outlet 21 for reducing the pressure losses within the tank 10 and for guiding and separating the upwardly and downwardly moving vortices of fluid that exist in the apparatus 10 during operation. A third conduit 25 is provided in the bottom wall 12 substantially centrally therein. The third conduit 25 comprises an impurities outlet, providing for the exit of sand or like dense particulate impurities separated from the fluid by the apparatus 10. Valves 27 and 28 may be provided for periodically connecting the outlet 25 with a disposal conduit 29 for discharging sand that accumulates in the tank lower section 18.

According to the present invention, means are provided for preventing vertical stagnation of sand or the like against the side wall 13 interior at a particular vertical level without dampening the whirling motion imparted to the fluid when introduced through inlet 19. Such particle stagnation preventing means preferably comprises a funnel means, illustrated generally at 32 in the drawings; means defining perforations 34 in the funnel means 32 at areas thereof wherein stagnation of dense particulate impurities is likely to occur; and means for operatively mounting the funnel means to the tank side wall between the fluid inlet 19 and the impurities outlet 25 so that dense impurities being separated must pass through the funnel means 32 in transit to the impurities outlet 25, and so that the funnel means 32 at the areas of the perforations 34 thereof is spaced from the tank side wall 13 (particularly lower section 15 thereof) and the impurities outlet 25 is in open communication with the interior of the funnel means 32 through the perforations 34. The conical member 32 preferably comprises a frust-conical shell or mantel of sheet steel of uniform thickness.

One form of the funnel means 32 mounting means may take comprises an annular flange 35 (see FIG. 1) mounted to the exterior of the funnel means 32, the flange 35 received between the clamping means 14, 15 associated with the upper and lower sections of the side wall 13 with the clamping means holding the flange 35 in place with respect to the side wall. Bolts or like removable fasteners may be provided extending between the clamping means 14, 15 to effect the clamping action, and in general the funnel means 32 may be mounted so that it is readily removable from the apparatus 10 for replacement, servicing, or repair.

The perforations 34 formed in the funnel means 32 are formed at least in the area thereof below the annular flange 35, and may be regularly spaced circular apertures having a diameter of about 4 to 10 mm. While a regular pattern and size of perforations 34 may be provided, alternatively the size of the perforations may increase and the spacing therebetween decrease toward the lower end 39 of the funnel means 32. In any event, the perforations 34 are larger than the average dimensions of the particulate impurities (e.g., sand) in the apparatus 10 so that such impurities will pass through the perforations 34.

Figure 2:
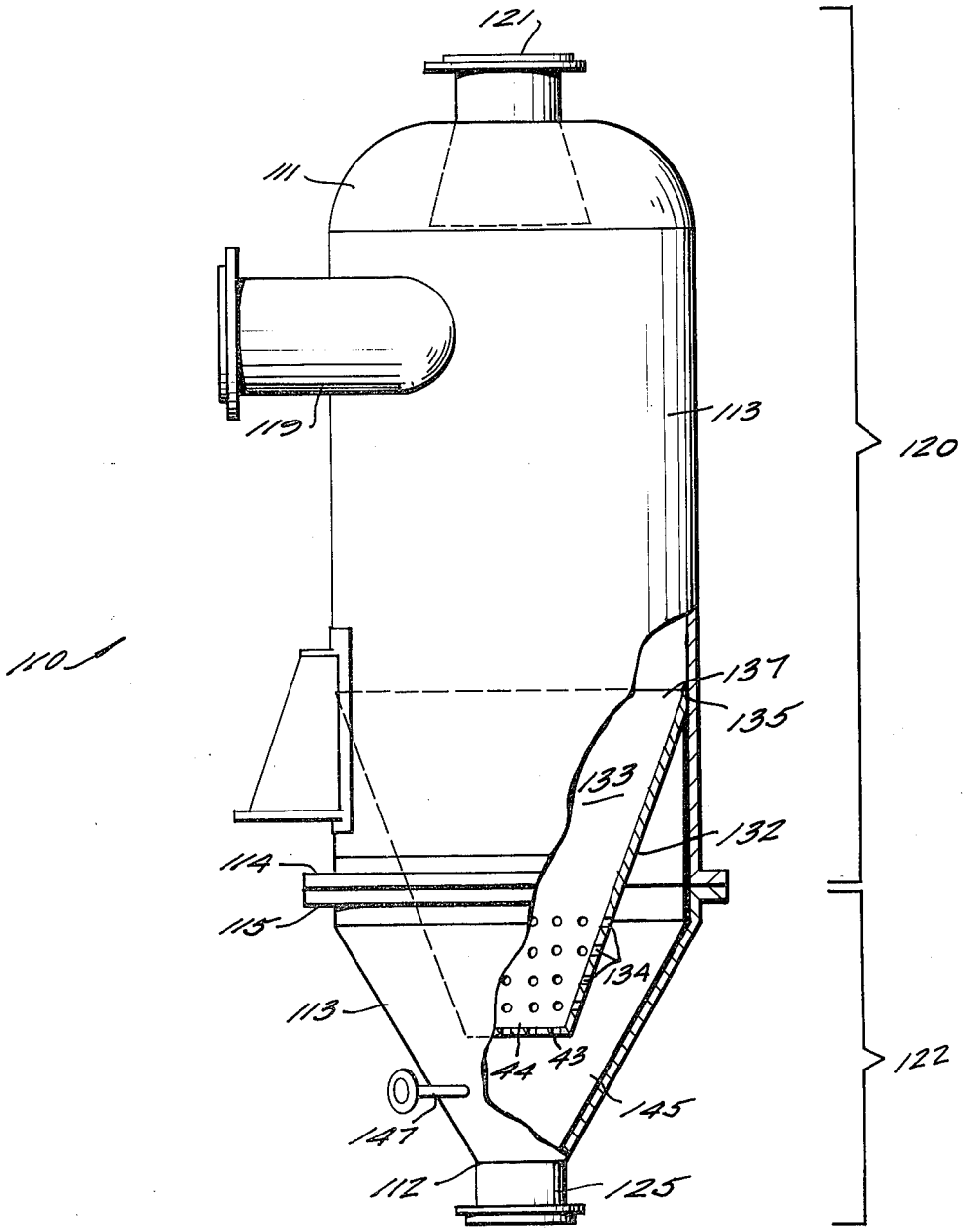
FIG. 2 is a side wall view, partly in cross-section and partly in elevation, of a conventional hydrocyclone which has been modified according to the present invention.

The funnel means 32 has a large open top 37, and a small bottom 39; preferably the funnel means 32 is a conical member as illustrated in the drawings. The area of the open end 37 is preferably about 10 to 20% of the maximum cross-sectional area of the tank. The second end 39 may be completely opened as illustrated in FIG. 1, or a radially extending flange 43 (see FIG. 2) may be provided at the bottom of the funnel 32. The flange 43 serves to guide the whirling motion so that the fluid is directed upwardly, and the whirling action does not to any significant degree propogate downwardly into the chamber 45. As illustrated in FIG. 2, the flange 43 may include means defining a central orifice 44 therein, the orifice 44 in vertical alignment with the impurities outlet (third conduit 25). Alternatively, the annular flange 43 may be widened to form a flat circular bottom which is either solid, or perforated over at least part of its face.

As previously discussed, preferably the upper section of the tank includes a lower portion 17 that is conical, and as illustrated the conicity of the funnel 32 is substantially the same as that of the tank upper section lower portion 17. In this way a smooth transition is provided between the tank side wall 13 and the funnel 32 portion including perforations 34. Preferably the angle $\alpha$ of concity of the funnel 32 and tank conical portion 17 is about 15° to 30°, which insures no unnecessary dampening of the whirling motion of the fluid and maximizes dense particulate impurities separation.

As illustrated in FIG. 1, the bottom 39 of the funnel means 32 is spaced from the conduit 25, a chamber 45 being provided between the tank lower section 18 and the funnel means 32. This chamber 45 facilitates the passage of sand or like particles separated from the fluid through the perforations 34 and down to the impurities outlet 25. In order to facilitate discharge of separated particles through the impurities outlet 25, a fourth conduit 47 may be provided associated with the tank. The fourth conduit 47 has a cross-sectional area smaller than the cross-sectional area of the first conduit 19 and is tangentially disposed with respect to the side wall 13 of the tank lower section 18 so as to introduce liquid under pressure tangentially into the volume 45. This introduction of liquid provides a whirling action which entrains sand or like separated particles and washes them through the impurities outlet 25 when valve 27 is open. The whirling action of the liquid in the volume 45 is much calmer than that provided for the fluid introduced through inlet 19.

FIG. 2 illustrates a conventional hydrocyclone that has been readily modified according to the present invention to prevent vertical stagnation of dense impurities against the side wall without dampening the whirling action imparted to the fluid. In FIG. 2 structures corresponding to the structures in FIG. 1 are given the same reference numeral preceeded by a "1".

The apparatus 110 of FIG. 2 includes a tank upper portion 120 and a tank lower portion 122, the upper portion 120 being substantially cylindrical while the lower portion 122 is conical. According to the present invention, the funnel means 132 has perforations 134 formed therein only adjacent the bottom thereof, while a top portion—designated generally at 133—is relatively free of perforations. The means 135 for mounting the funnel means 132 to the tank side wall 113 comprise means for rigidly attaching the large end to 137 of the funnel 132 to the interior side wall at the cylindrical portion 120 so that the funnel means 132 extends concentrically downwardly into the tank lower portion 122 spaced from the side wall 113 of the lower portion 122. This rigid attaching means 135 may comprise a continuous weld around the periphery of the funnel open top 137. The chamber 145 is formed between the exterior of the funnel 132 and the side walls 113 of the conical bottom portion 122. Modification of a conventional hydrocyclone according to the invention may thus easily be provided by separating the tank upper and lower portions 120, 122 by disconnecting them at clamping means 114, 115, inserting the large end 137 of the funnel means 132 into the tank upper portion 120 so that it engages the interior of the side wall 113 thereof, and welding (at 135) the funnel means 132 in place. Should any portion of the apparatus 110 wear out as a result of abrasive action of separated particles it will probably be the funnel means 132, which then may be readily removed and a new component inserted, as described above.

As an alternative to the structure of FIG. 2, conventional hydrocyclones can be rebuilt in accordance with the present invention by perforating the conical portion 122 thereof, and enclosing that portion 122 with an exterior vessel similar to the section 18 illustrated in FIG. 1, and shifting the outlet 25 to the bottom of the latter. With respect to all embodiments of the invention, instead of being circular holes, the perforations may be formed as slits, and the funnel may have a broken or curved contour.

Apparatus as described above can be advantageously utilized for the purification of digesting liquor recirculated in connection with the supply of chips to continuous cellulose digesters, and for the separation of sand or similar solid impurities out of other liquids used in cellulose production, such as liquids for washing or bleaching of pulp or for washing of chips.

Operation

According to the method of separating sand or like dense particulate impurities from a fluid suspension containing the impurities may be readily practiced with either the apparatus 10 or the apparatus 110. With reference to the apparatus 10, operation is as follows:

A fluid suspension containing sand or like dense particulate impurities is continuously introduced into first conduit 19 to impart a whirling motion to the fluid within the tank of the apparatus 10. The whirling action causes downwardly and upwardly moving vortices to be generated within the tank with sand or like dense impurities being moved toward the tank walls and eventually moving downwardly in the apparatus 10. Fluid with the sand or like dense impurities separated therefrom is continuously removed through the third conduit 21 while sand or like dense impurities is periodically removed through the third conduit 25.

The funnel 32 is provided to prevent vertical stagnation of sand or like dense impurities against the side wall interior without dampening the whirling action imparted to the fluid. The funnel 32 is disposed at a vertical level at which vertical stagnation, as a result of the resolution of the centrifical and gravity forces acting on the sand particles, is likely to occur, although the particles will continue to rotate as a result of the fluid whirling action. Since perforations 34 are provided in the funnel 32 at this zone of stagnation, as the particles rotate they will pass through the perforations 34 and fall into the chamber 45. Removal of the sand from the chamber 45 may be facilited by introducing liquid under pressure through fourth conduit 47 to impart a whirling action thereto to entrain the separated sand and carry it through the conduit 25 to conduit 29. The whirling action of the fluid introduced through conduit 47 is substantially less than the whirling action above the funnel 32 so that the volume 45 is relatively stagnant and the separated particles will readily descend through perforations 34 toward the bottom wall 12. Any less-dense particles (such as wood fragments) accompany the rising liquid votex toward and through the fluid outlet 21 which is of advantage from a fractionation point of view.

It will thus be seen that according to the present invention that a method and an apparatus have been provided which prevent vertical stagnation of dense impurities against a hydrocyclone side wall interior without dampening the whirling motion imparted to the fluid. While the invention has been herein shown and described in what is presently conceived to be the most practical and preferred embodiment thereof, it will be apparent that many modifications may be made thereof within the scope of the invention. Thus the invention is to be accorded the broadest interpretation of the appended claims so as to encompass all equivalent apparatus and methods.

What is claimed is:

1. Apparatus for removing dense impurities from a fluid comprising a vertically upstanding tank substantially circular in cross-section and including a top wall, bottom wall, and side wall;

means for introducing fluid having impurities into said tank adjacent to the top wall thereof and tangentially to the side wall, to impart whirling motion to the fluid within the tank;

a fluid outlet disposed substantially centrally in the top wall of the tank;

an impurities outlet disposed substantially centrally in the bottom wall of the tank; and means for preventing vertical stagnation of dense impurities against the side wall interior at a particular vertical level without dampening the whirling motion imparted to the fluid, said means comprising: a funnel means; means defining perforations larger than the average dimensions of the impurities in said funnel means at areas thereof wherein stagnation of dense impurities is likely to occur; and means for operatively mounting said funnel means to said tank side wall between said fluid inlet and said impurities outlet so that dense impurities being separated must pass through said funnel means in transit to said impurities outlet, and so that said funnel means at said perforated areas thereof is spaced from said tank side wall and said impurities outlet is in open communication with the interior of said funnel means through said perforations.

2. Apparatus as recited in claim 1 wherein said funnel means comprises a conical member having an open large end, and a small end, said means for operatively mounting said funnel mounting it so that said open large end is above said small end.

3. Apparatus as recited in claim 2 wherein said funnel small end includes a radially extending flange.

4. Apparatus as recited in claim 3 wherein said radially extending flange includes means defining a central orifice therein, the orifice in vertical alignment with said impurities outlet.

5. Apparatus as recited in claim 2 wherein said means for mounting said funnel means to sad tank side wall comprises an annular flange rigidly mounted to the exterior of said funnel means, and clamping means associated with upper and lower sections of said side wall for receiving said flange therebetween and holding it in place with respect to said side wall.

6. Apparatus as recited in claim 5 wherein said means defining perforations in said funnel means define regularly spaced circular apertures having a diameter of about 4–10 mm in substantially the entire portion of said funnel means between said annular flange and said impurities outlet.

7. Apparatus as recited in claim 5 wherein said tank side wall upper section includes a top cylindrical portion, and a bottom conical portion having a said clamping means associated therewith, and wherein said conical member and said tank upper section conical bottom portion have substantially the same conicity.

8. Apparatus as recited in claim 7 wherein the angle of conicity of said funnel means and said tank conical portion is 15°–30°.

9. Apparatus as recited in claim 2 wherein said tank side wall comprises a cylindrical upper portion and a conical lower portion, and wherein said means for mounting said funnel means to said tank side wall comprises means for rigidly attaching said funnel means large end to the interior of said side wall at said cylindrical portion so that said funnel means extend concentrically, downwardly into the tank lower portion spaced from said side wall of the lower portion.

10. Apparatus as recited in claim 1 wherein said means defining perforations in said funnel means define regularly spaced circular apertures having a diameter of about 4–10 mm.

11. Apparatus as recited in claim 1 further comprising means for facilitating discharging of separated impurities through said impurities outlet, said means comprising means for introducing liquid under pressure tangentially into the volume between said funnel means and said tank bottom wall.

12. Apparatus for removing dense particles from a suspension, comprising:

a vertically upstanding tank substantially circular in cross-section and including a top wall, bottom wall, and side wall, said side wall comprising a cylindrical upper portion and a conical lower portion;

a first conduit in communication with the tank interior and extending tangentially to said side wall and adjacent said top wall;

a second conduit disposed substantially centrally in the top wall of said tank;

a third conduit disposed substantially centrally in the bottom wall of the tank;

funnel means having a relatively large open first end and a relatively small second end;

means defining perforations larger than the average dimensions of the dense particles in at least areas of said funnel means adjacent the second end thereof; and means for operatively mounting said funnel means to said tank side wall between said first conduit and said third conduit so that said funnel means first end is vertically above said second end, so that any suspension, particles, or the like passing between said first and third conduits must pass through said funnel means, and so that said funnel means at said perforated areas thereof is spaced from said tank side wall with said funnel means second end above said third conduit and with said third conduit being in open communication with the interior of said funnel means through said perforations; said means comprising means for rigidly attaching said funnel means large end to the interior of said side wall at said cylindrical portion so that said funnel means extend concentrically, downwardly into the tank lower portion spaced from said side wall of the lower portion.

13. Apparatus as recited in claim 12 wherein said funnel means is conical.

14. Apparatus as recited in claim 13 wherein said means for mounting said funnel means to said tank side wall comprises an annular flange rigidly mounted to the exterior of said funnel means, and clamping means associated with upper and lower sections of said side wall for receiving said flange therebetween and holding it in place with respect to said side wall.

15. Apparatus as recited in claim 14 wherein said tank side wall upper section includes a top cylindrical portion, and a bottom conical portion having a said clamping means associated therewith, and wherein said conical member and said tank upper section conical bottom portion have substantially the same conicity.

16. Apparatus as recited in claim 15 wherein the angle of conicity of said funnel means and said tank conical portion is 15°–30°.

17. Apparatus as recited in claim 12 wherein said means defining perforations in said funnel means define regularly spaced circular apertures having a diameter of about 4–10 mm.

18. Apparatus as recited in claim 12 further comprising a fourth conduit in communication with the tank interior and extending tangentially to said side wall at a portion thereof between said bottom wall and said funnel means, said fourth conduit having a smaller cross-sectional area than said first conduit.

19. Apparatus as recited in claim 12 further comprising a sleeve extending from said second conduit into the tank interior.

20. A method of separating sand or like dense impurities from a fluid containing the impurities, utilizing a vertically upstanding tank substantially circular in cross-section and including a top, a bottom, and a side wall; a first conduit extending into communication with the tank interior and extending tangentially to the side wall; a second conduit disposed substantially centrally in the top wall of the tank; and a third conduit disposed substantially centrally in the bottom wall of the tank; said method comprising the steps of:

(a) continuously introducing fluid containing sand or like dense impurities into the first conduit to impart a whirling motion to the fluid within the tank;

(b) continuously removing fluid with the sand or like dense impurities separated therefrom through the second conduit;

(c) periodically removing sand or like dense impurities separated from the liquid through the third conduit; and (d) preventing vertical stagnation of sand or like dense impurities against the side wall interior at a particular vertical level without dampening the whirling motion imparted to the fluid by utilizing a funnel having an open large first end and a small second end with perforations disposed in at least the area of the funnel adjacent the second end: and by operatively mounting the funnel to the tank side wall, so that the first end thereof is vertically above the second end thereof, so that all sand or like dense impurities to pass through the third conduit must pass through the funnel, and so that the funnel at the areas thereof containing the perforations is spaced from the tank side wall and in open communication with the third conduit.

21. A method as recited in claim 18 consisting of steps (a)–(d), and wherein step (c) is accomplished in part by introducing liquid under pressure tangentially to the tank side wall into the tank interior between the funnel and the third conduit to provide a whirling action which entrains separated sand or like dense impurities and carries it through the third conduit, the whirling action of liquid in accomplishing step (c) being calmer then the whirling action of fluid in accomplishing step (a).

* * * * *